US007971514B2

(12) United States Patent
Alalu

(10) Patent No.: US 7,971,514 B2
(45) Date of Patent: Jul. 5, 2011

(54) APPARATUS AND A PRODUCTION PROCESS FOR PRODUCING ROLLS OF DISPOSABLE PIECES OF HYGIENIC PAPER

(76) Inventor: Avraham Alalu, Bnei Brak (IL)

( * ) Notice: Subject to any disclaimer, the term of this patent is extended or adjusted under 35 U.S.C. 154(b) by 376 days.

(21) Appl. No.: 12/071,413

(22) Filed: Feb. 21, 2008

(65) Prior Publication Data

US 2009/0212153 A1 Aug. 27, 2009

(51) Int. Cl.
*B26D 1/12* (2006.01)

(52) U.S. Cl. ..... 83/678; 83/408

(58) Field of Classification Search ..... 83/408, 83/678

See application file for complete search history.

(56) References Cited

U.S. PATENT DOCUMENTS

| | | | | |
|---|---|---|---|---|
| 3,162,076 | A * | 12/1964 | Emerson et al. | 83/678 |
| 3,891,494 | A * | 6/1975 | Hunter | 83/678 |
| 4,074,599 | A * | 2/1978 | Allen | 83/678 |
| 4,167,130 | A * | 9/1979 | Miller | 83/678 |
| 4,615,671 | A * | 10/1986 | Bernal | 83/332 |
| 6,035,753 | A * | 3/2000 | Coffey | 83/678 |
| 7,137,539 | B2 * | 11/2006 | Jackson | 83/678 |
| 2006/0011030 | A1 * | 1/2006 | Wagner et al. | 83/678 |

* cited by examiner

*Primary Examiner* — William A Rivera
(74) *Attorney, Agent, or Firm* — Mark M. Friedman

(57) ABSTRACT

An apparatus and a production process for producing rolls of disposable pieces of hygienic paper, including the stages of: cutting perforated lateral lines on said hygienic paper, wherein each of the lateral spaces of the perforated lateral lines is shorter than each of the lateral perforations of the perforated lateral lines, wherein each of said lateral spaces is facing one of the lateral perforations of a neighboring perforated lateral line, rolling the hygienic paper around inner tube, and cutting longitudinal cuts along the hygienic paper and the inner tube, the apparatus including spiral and segmented blades for cutting the perforated lateral lines, and knives for longitudinal cutting.

10 Claims, 6 Drawing Sheets

APPARATUS AND A PRODUCTION PROCESS FOR PRODUCING ROLLS OF DISPOSABLE PIECES OF HYGIENIC PAPER

FIELD OF THE INVENTION

The present invention relates to an apparatus and a production process for producing rolls of disposable pieces of hygienic paper, and in particular to an apparatus and a production process, for producing rolls of toilet paper and paper towels that enable removal of a piece of paper for use without needing to tear the paper prior to use.

BACKGROUND OF THE INVENTION

A roll of disposable pieces of hygienic paper is described in U.S. patent application Ser. No. 11/271,891 of Alalu, the present invention inventor, et al., which is incorporated by reference for all purposes as if fully set forth herein. Prior to the invention of the roll of disposable pieces of hygienic paper by Alalu et al., there was no machine or method which enabled production of such rolls.

There is a need for an apparatus and a production process for producing rolls of disposable pieces of hygienic paper.

SUMMARY OF THE INVENTION

The present invention relates to an apparatus and a production process for producing rolls of disposable pieces of hygienic paper, for use without needing to tear the paper prior to use.

An embodiment of the present invention is described herein below in which an apparatus enables feeding hygienic paper which comes in a large roll, performing partial and gradated lateral cuts, as will be described in the following specification, and afterwards rolling the hygienic paper onto an inner tube of a rigid material and performing longitudinal cuts, which will also be described in the following specification, to obtain separate rolls which embody the desired product in the form of rolls of disposable pieces of hygienic paper, enabling use without any prior need to tear the paper.

According to some embodiments of the present invention there is provided an apparatus for producing rolls of disposable pieces of hygienic paper, the apparatus including: (a) a spiral blade cylinder having a spiral blade cylinder rotation axis; (b) a spiral blade having a spiral blade radius, wherein the spiral blade is disposed at the spiral blade cylinder; (c) a segmented blade cylinder having a segmented blade cylinder rotation axis; (d) a first segmented blade having a segmented blade radius, at least two bladed segments, and at least two blade lateral spaces, the first segmented blade is disposed at the segmented blade cylinder, wherein each one of the bladed segments has a width larger than each one of the blade lateral spaces' width dimension; and (e) a second segmented blade having a segmented blade radius, at least two bladed segments, and at least two blade lateral spaces, the second segmented blade is disposed at the segmented blade cylinder, wherein each one of the bladed segments has a width larger than each one of the blade lateral spaces' width dimension, wherein the segmented blade cylinder rotation axis, the first segmented blade, and the second segmented blade are laying on a common plane, wherein a bladed segment of the first segmented blade is facing a lateral space of the second segmented blade, and wherein the distance between the spiral blade cylinder rotation axis and the segmented blade cylinder rotation axis is substantially the sum of the spiral blade radius and the segmented blade radius.

According to still further features in the described embodiments the apparatus for producing rolls of disposable pieces of hygienic paper further includes (f) an internal cylinder for carrying rolls of hygienic paper, wherein a roll of hygienic paper can be loaded on the internal cylinder for carrying rolls of hygienic paper; and (g) an internal cylinder for carrying an inner tube, wherein an inner tube can be loaded on the internal cylinder for carrying an inner tube, and wherein the hygienic paper can move from the roll of hygienic paper and to be rolled around the inner tube, to form a roll of hygienic paper, with perforated lateral lines rolled onto the inner tube.

According to still further features in the described embodiments the apparatus for producing rolls of disposable pieces of hygienic paper further includes (h) a knife for lateral cutting enabling separation of the roll of hygienic paper (with perforated lateral lines) rolled onto an inner tube from the remaining hygienic paper.

According to still further features in the described embodiments the apparatus for producing rolls of disposable pieces of hygienic paper further includes (i) at least one knife for longitudinal cutting, enabling separation of rolls of disposable pieces of hygienic paper from the roll of hygienic paper (with perforated lateral lines) rolled onto an inner tube.

According to some embodiments of the present invention there is provided a process for producing rolls of disposable pieces of hygienic paper including the stages of: (a) providing hygienic paper with a surface and thickness, width, and length dimensions, for producing rolls of disposable pieces of hygienic paper with predetermined width, and length dimensions of the pieces of hygienic paper; (b) cutting a first perforated lateral line on the hygienic paper, wherein the perforated lateral line includes at least two lateral perforations and at least one lateral space, wherein the lateral space is shorter than one of the lateral perforations; (c) cutting a second perforated lateral line on the hygienic paper, wherein the perforated lateral line includes at least two lateral perforations and at least one lateral space, wherein each of the lateral spaces of the second perforated lateral line is shorter than one of the lateral perforations of the second perforated lateral line, wherein each of the lateral spaces of the first perforated lateral line is facing one of the lateral perforations of the second perforated lateral line; (d) cutting additional perforated lateral lines, wherein there is a longitudinal distance between each of every two neighboring even-numbered perforated lateral line and between each of every two neighboring odd-numbered perforated lateral line, and wherein the longitudinal distance is determining the disposable pieces of hygienic paper length dimensions.

According to still further features in the described embodiments the process for producing rolls of disposable pieces of hygienic paper further includes the stages of: (e) providing an inner tube; and (f) rolling the hygienic paper around the inner tube.

According to still further features in the described embodiments the process for producing rolls of disposable pieces of hygienic paper further includes the stages of: (g) cutting longitudinal cuts along the hygienic paper and cutting the inner tube, wherein there is a lateral space between each of every two of the neighboring longitudinal cuts, and wherein the lateral space is determining the disposable pieces of hygienic paper width dimensions.

According to some embodiments of the present invention there is provided a roll of disposable pieces of hygienic paper from which disposable pieces of hygienic paper can be removed with one hand without any need for tearing or cutting the hygienic paper including: (a) an inner tube of a rigid material with a symmetry axis and external radius and height dimensions such that the section of the inner tube perpendicular to the symmetry axis is substantially round for the entire height; and (b) at least two disposable pieces of hygienic paper with a surface and thickness, and has a rectangular shape with width and length dimensions, and with two long edges and two short edges, deployed so as to synchronously rotate the roll of disposable pieces of hygienic paper when one of the disposable pieces of hygienic paper is removed, with the disposable pieces of hygienic paper packed onto the inner tube and onto themselves such that:

(i) each of the disposable pieces of hygienic paper has a cylindrical shape, with a spiral section around the symmetry axis of the inner tube;

(ii) all of the disposable pieces of hygienic paper are substantially packed to be fully overlapping in the width dimension of each piece; and (iii) each of the disposable pieces of hygienic paper is substantially packed to be partially overlapping in its length dimension with regard to each adjacent disposable piece of hygienic paper that it is in contact with, wherein one of the short edges of each of the disposable pieces of hygienic paper is substantially in close proximity to the adjacent disposable pieces of hygienic paper.

According to still further features in the described embodiments the roll of disposable pieces of hygienic paper from which disposable pieces of hygienic paper can be removed with one hand without any need for tearing or cutting wherein at each one of the long edges of at least most of the disposable pieces of hygienic paper there is a perforated lateral line.

Additional objects and advantages of the invention will be set forth in part in the description which follows and, in part, will be obvious from the description, or may be learned by practice of the invention.

BRIEF DESCRIPTION OF THE DRAWINGS

The invention is herein described, by way of example only, with reference to the accompanying drawings, wherein.

DETAILED DESCRIPTION OF EMBODIMENTS

Figure 1A:
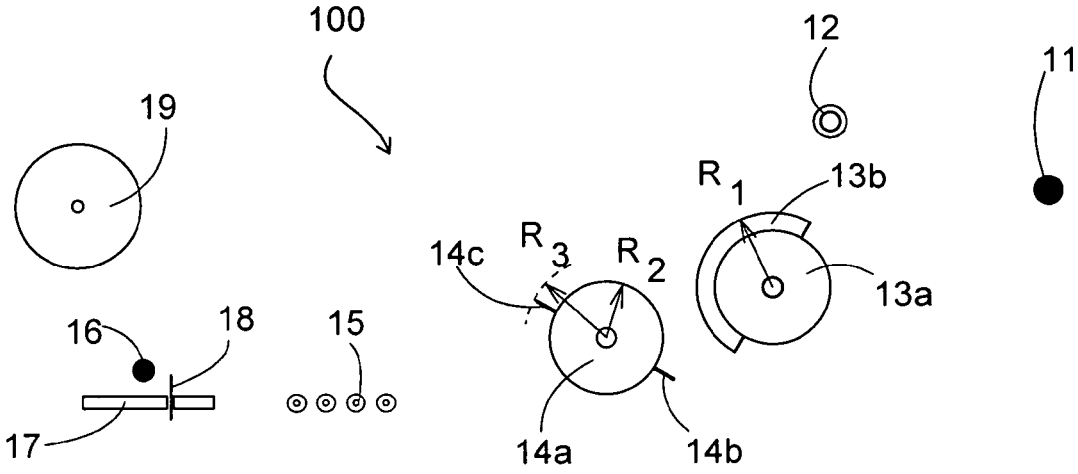
FIG. 1*a* is a side view schematic illustration of an exemplary, illustrative embodiment of an apparatus for producing rolls of disposable pieces of hygienic paper, according to the present invention.

The present invention is of an apparatus and a production process for producing rolls of toilet paper and paper towels that enable removal of a piece of paper for use without needing to tear the paper prior to use.

The principles and operation of an apparatus and a production process according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The following list is a legend of the numbering of the application illustrations:

100 apparatus for producing rolls of disposable pieces of hygienic paper
11 internal cylinder for carrying rolls of hygienic paper
12 cylinder for leading hygienic paper
13*a* spiral blade cylinder
13*b* spiral blade
13*c* rotational axis of the spiral blade cylinder
14*a* segmented blade cylinder
14*b* first segmented blade
14*c* second segmented blade
14*d* bladed segment
14*e* blade lateral space
14*f* rotational axis of the segmented blade cylinder
15 support cylinder
16 internal cylinder for carrying an inner tube
17 grooved table
18 knife for lateral cutting
19 knife for longitudinal cutting
21 roll of hygienic paper
22 inner tube (of a rigid material)
23 roll of hygienic paper (with perforated lateral lines) rolled onto an inner tube
24 rolls of disposable pieces of hygienic paper
30*a* hygienic paper
30*b* hygienic paper with perforated lateral lines

30*c* hygienic paper with longitudinal cuts (with perforated lateral lines)
31 odd-numbered perforated lateral line
32 even-numbered perforated lateral line
33 longitudinal cut
41 lateral perforation (of perforated lateral line)
42 lateral space (of perforated lateral line)
50*a* disposable piece of hygienic paper
50*b* short edge (of a disposable piece of hygienic paper)
50*c* long edge (of a disposable piece of hygienic paper)
50*d* remaining lateral perforation
$R_1$ spiral blade radius
$R_2$ segmented blade cylinder radius
$R_3$ segmented blade radius
$d_1$ distance from the first edge of the first segment of the first segmented blade
$d_2$ the lateral distance between two adjacent segmented blades
$d_3$ length dimension of a segmented blade
$d_4$ distance from the second edge of the last segment of the first segmented blade
$d_5$ longitudinal distance (between every two adjacent odd-numbered perforated lateral lines, and between every two adjacent even-numbered perforated lateral lines)
$d_6$ distance between two adjacent longitudinal cuts
$d_7$ blade lateral space base dimension Referring now to the drawings, FIG. 1*a* is a side view schematic illustration of an exemplary, illustrative embodiment of an apparatus for producing rolls of disposable pieces of hygienic paper 100, according to the present invention. Apparatus for producing rolls of disposable pieces of hygienic paper 100 includes: internal cylinder for carrying rolls of hygienic paper 11, cylinder for leading hygienic paper 12, support cylinders 15, and internal cylinder for carrying an inner tube 16. These are all for the method of feeding roll of hygienic paper (21) to the apparatus for producing rolls of disposable pieces of hygienic paper 100 and rolling it as a roll of hygienic paper rolled onto an inner tube 23 (with perforated lateral lines) as will be further detailed in the following.

Furthermore, apparatus for producing rolls of disposable pieces of hygienic paper 100 includes blades, for cutting perforated lateral lines in the hygienic paper, which include one or more continuous spiral blades 13*b*, assembled to a spiral blade cylinder 13*a*, and, at a suitable distance for performing cutting, first segmented blade 14*b* and second segmented blade 14*c*, or any other suitable number of segmented blades, assembled to segmented blade cylinder 14*a*. When the spiral blade 13*b* rotates counter clockwise, as shown in the illustration, the segmented blades rotate clockwise, as shown in the illustration, and in suitable cases, when the distance between the rotational axis of the spiral blade cylinder 13*c* and the rotational axis of the segmented blade cylinder 14*f* is practically the sum of the spiral blade radius $R_1$ and the segmented blade radius $R_3$, an infinitesimal space is achieved, very close to contact in a single point, which is in constant motion, between the spiral blade 13*b* and one of the segments of one of the segmented blades. When hygienic paper is disposed between them, it will be cut according to the motion of this point, while the rotational speed of the spiral blade 13*b* is twice the rotational speed of first segmented blade 14*b* and second segmented blade 14*c*, or at a different rotational speed ratio according to the number of blades.

Segmented blade cylinder 14*a* has a segmented blade cylinder radius $R_2$ which is the main factor determining the distance between the perforated lateral lines, and is designed according to the desired length dimension of each of the disposable pieces of hygienic paper (50*a*).

All of the cylinders shown in the illustration rotate synchronously by means of a suitable mechanic drive, excluding cylinder for leading hygienic paper 12, and the support cylinders 15, which can be without any drive other than the effect of the movement of the hygienic paper which is in contact with them.

Furthermore, the apparatus for producing rolls of disposable pieces of hygienic paper 100 includes a device for performing full lateral cutting of the hygienic paper. This device can include knife for lateral cutting 18 which can move within grooved table 17, or any other suitable device.

In addition, the apparatus for producing rolls of disposable pieces of hygienic paper 100 includes a device for performing cutting in inner tube (22) and in roll of hygienic paper rolled onto an inner tube 23 (with perforated lateral lines), namely for creating longitudinal cuts (33) in the hygienic paper. This device can include one knife for longitudinal cutting 19, or more, and it doesn't need to be in a specifically defined position with regard to the other aforementioned components.

Figure 1B:
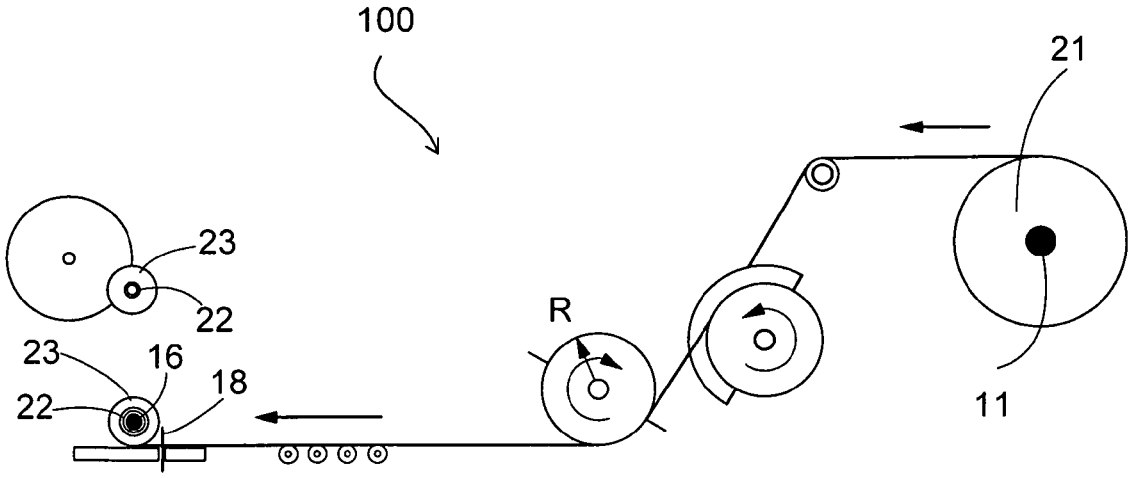
FIG. 1*b* is a side view schematic illustration of an exemplary, illustrative embodiment of an apparatus for producing rolls of disposable pieces of hygienic paper, containing hygienic paper, according to the present invention.

FIG. 1*b* is a side view schematic illustration of an exemplary, illustrative embodiment of an apparatus for producing rolls of disposable pieces of hygienic paper 100 containing hygienic paper according to the present invention.

A roll of hygienic paper 21, which serves as raw material, is fed into apparatus for producing rolls of disposable pieces of hygienic paper 100, and its end is pulled through until it is connected to inner tube 22, which is made of a rigid material such as cardboard, which is also fed as a raw material into apparatus for producing rolls of disposable pieces of hygienic paper 100.

The hygienic paper is cut with perforated lateral lines at required spaces, and is gathered by rolling onto the inner tube 22, as a roll of hygienic paper rolled onto an inner tube 23. After the desired length of hygienic paper is gathered, the hygienic paper is cut in its entire width, and the inner tube 22, and the roll of hygienic paper rolled onto an inner tube 23, (with perforated lateral lines) are moved to a cutting device for creating longitudinal cuts (33).

Figure 2:
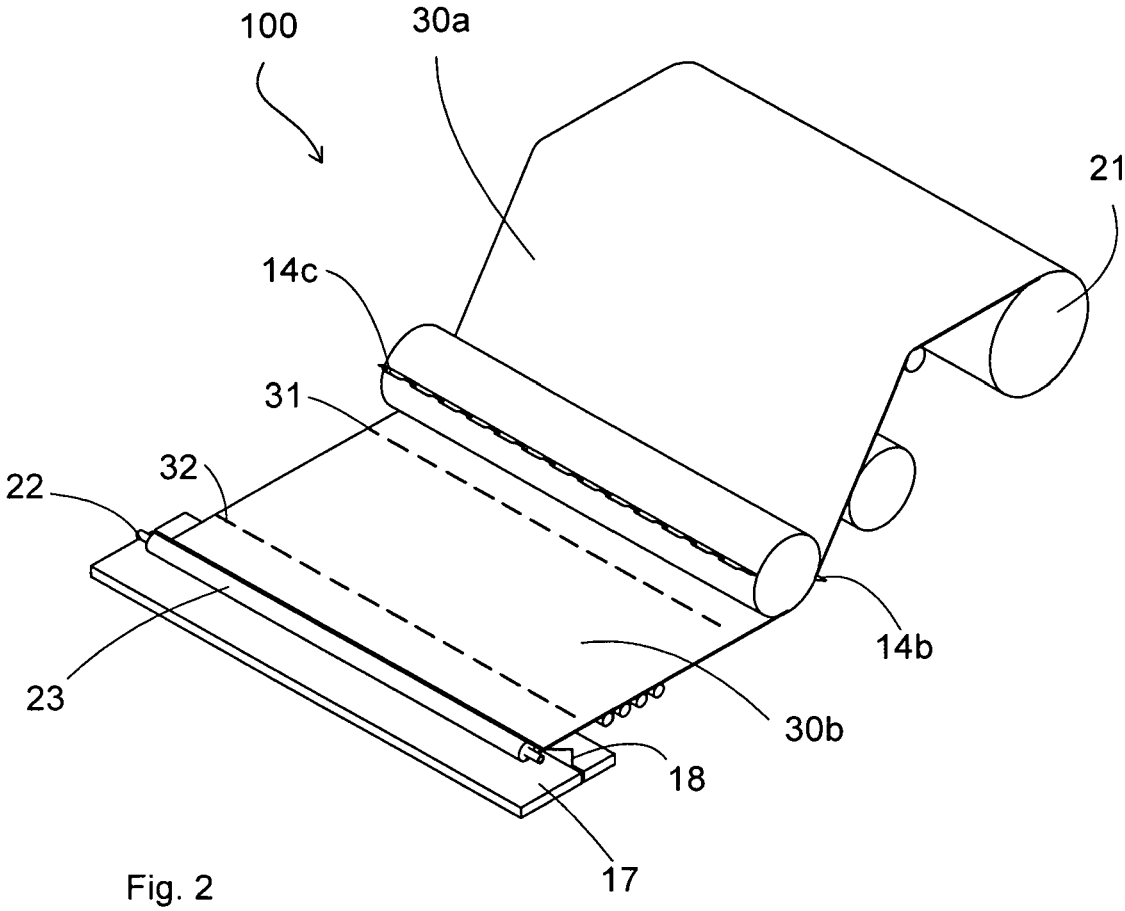
FIG. 2 is a perspective schematic illustration of an exemplary, illustrative embodiment of an apparatus for producing rolls of disposable pieces of hygienic paper, containing hygienic paper, according to the present invention.

FIG. 2 is a perspective schematic illustration of an exemplary, illustrative embodiment of an apparatus for producing rolls of disposable pieces of hygienic paper, containing hygienic paper, according to the present invention.

The hygienic paper 30*a* is pulled from the roll of hygienic paper 21, and after passing through the first segmented blade 14*b* and second segmented blade 14*c*, it becomes hygienic paper with perforated lateral lines 30*b*.

Figure 3:
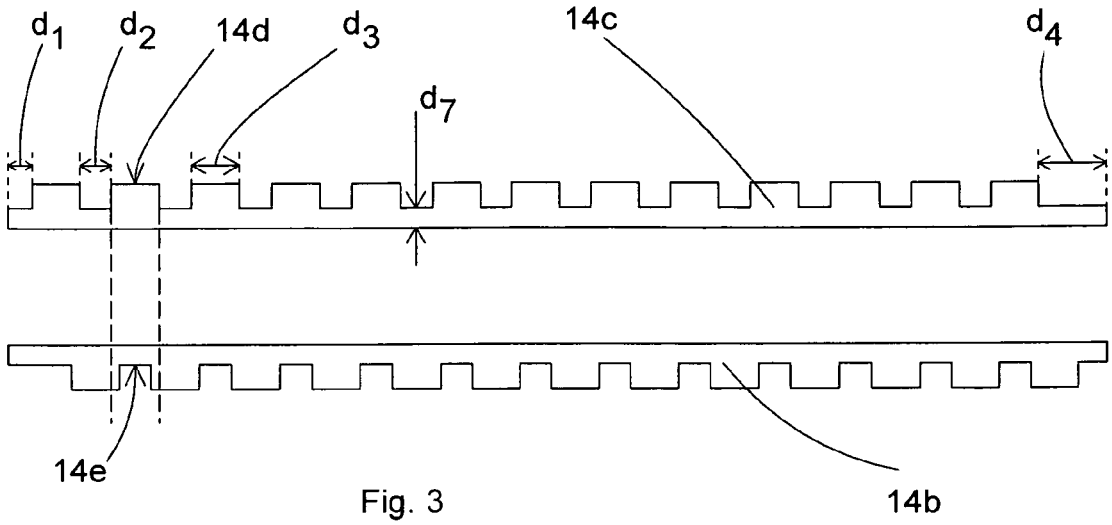
FIG. 3 is a side view schematic illustration of an exemplary, illustrative embodiment of a first segmented blade and a second segmented blade, according to the present invention.

FIG. 3 is a side view schematic illustration of an exemplary, illustrative embodiment of a first segmented blade 14*b* and a second segmented blade 14*c*, according to the present invention.

Each segmented blade has bladed segments 14*d*, each of whose length dimensions is $d_3$, and between the two a blade lateral space 14*e*, the lateral distance between two adjacent segmented blades $d_2$. $d_1$ and $d_4$ can also be spaced at both ends of each segmented blade. The dimensions are designed such that $d_3>d_2$.

Blade lateral space 14*e* has depth enabling a certain predetermined blade lateral space base dimension $d_7$ which can be zero or other than zero.

In the arrangement, as shown in the illustrations of the present application, including one first segmented blade 14*b* and one second segmented blade 14*c*, the blades are disposed at 180 degrees relative to each other, around a common rotational axis. They are laterally deviated with regard to each other so that each bladed segment 14*d* is facing a blade lateral space 14*e*.

Figure 4:
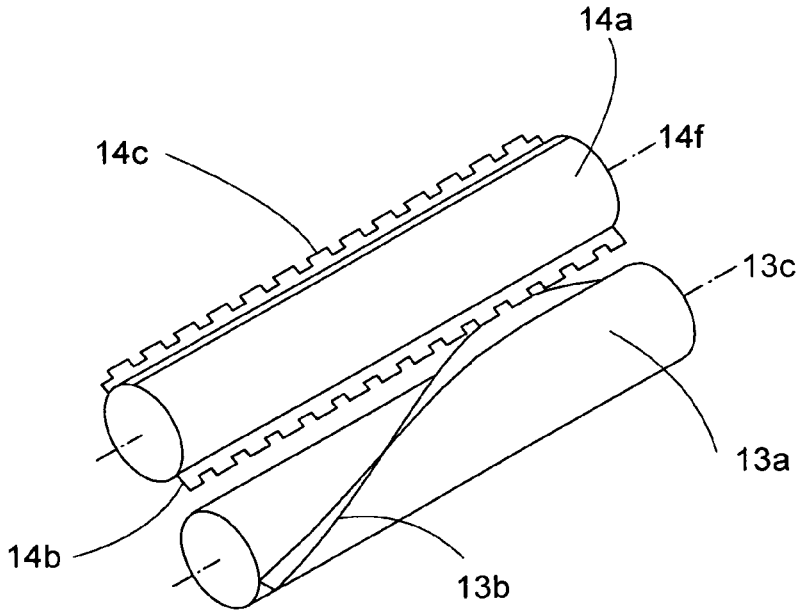
FIG. 4 is a perspective schematic illustration of an exemplary, illustrative embodiment of segmented blade cylinder carrying the first segmented blade and the second segmented blade, and the spiral blade cylinder carrying the spiral blade, according to the present invention.

FIG. 4 is a perspective schematic illustration of an exemplary, illustrative embodiment of segmented blade cylinder 14*a* carrying the first segmented blade 14*b*, and the second segmented blade 14*c*, and the spiral blade cylinder 13*a*, which carries the spiral blade 13*b*, according to the present invention.

This illustration clearly shows spiral blade 13*b*.

Figure 5A:
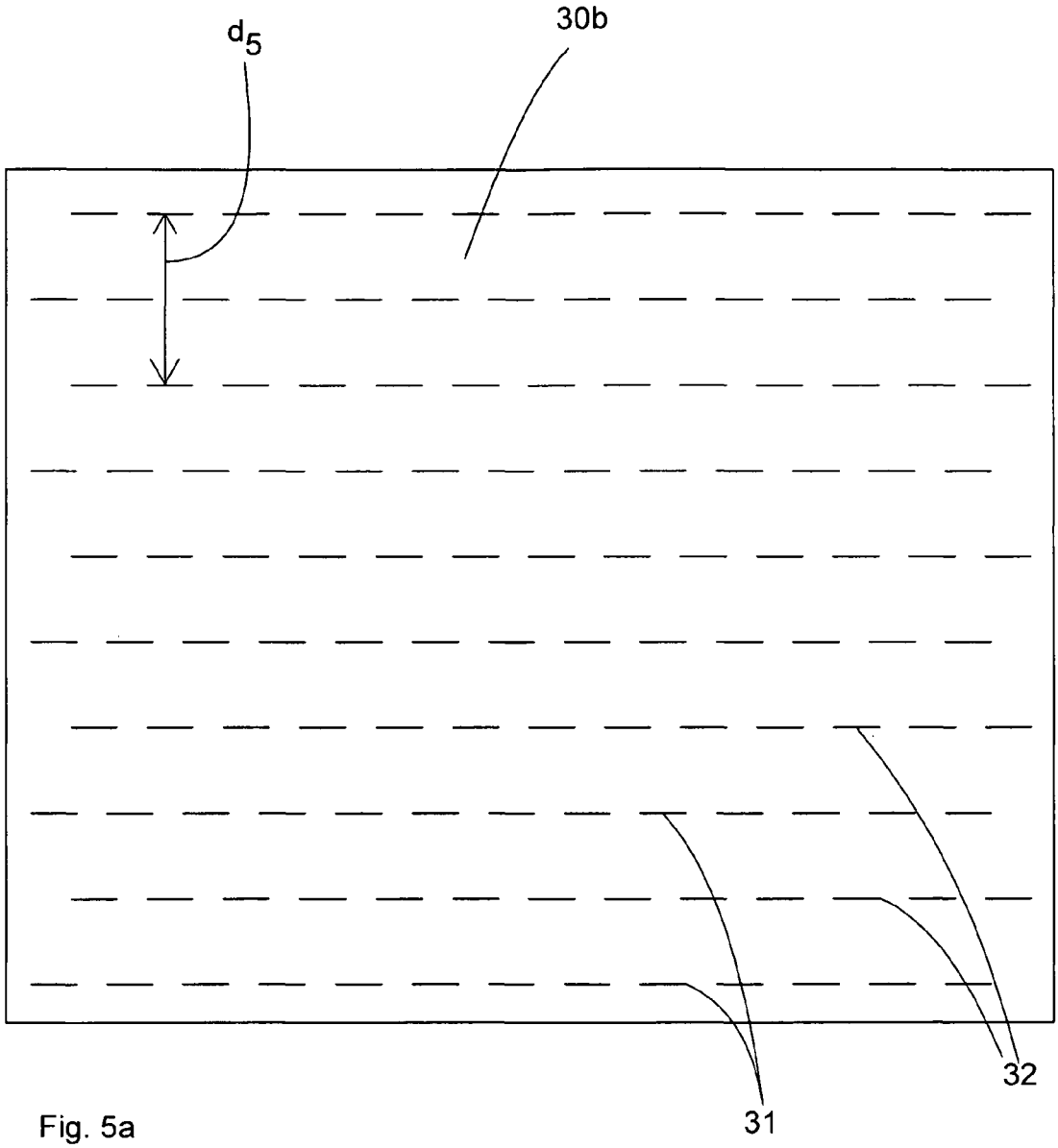
FIG. 5*a* is a top view schematic illustration of an exemplary, illustrative embodiment of hygienic paper with perforated lateral lines, according to the present invention.

FIG. 5*a* is a top view schematic illustration of an exemplary, illustrative embodiment of hygienic paper with perforated lateral lines 30*b*, according to the present invention.

The hygienic paper with perforated lateral lines 30*b*, includes alternating odd-numbered perforated lateral lines 31 and even-numbered perforated lateral lines 32, while between each of every two neighboring even-numbered perforated lateral lines 32 and between each of every two neighboring odd-numbered perforated lateral lines 31, there is a longitudinal distance $d_5$ whose size is, as noted, primarily determined according to the size of the segmented blade cylinder radius $R_2$ of segmented blade cylinder 14*a*, while the size of blade lateral space base dimension $d_7$, when other than zero, also has an effect.

Figure 5B:
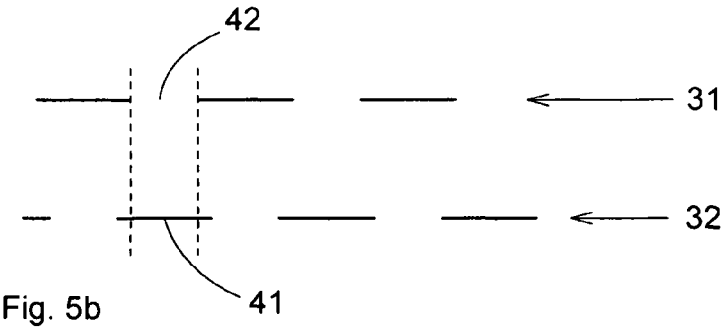
FIG. 5*b* is a top view schematic illustration of an exemplary, illustrative embodiment of two neighboring perforated lateral lines, an even-numbered perforated lateral line and an odd-numbered perforated lateral line, according to the present invention.

FIG. 5*b* is a top view schematic illustration of an exemplary, illustrative embodiment of two neighboring perforated lateral lines, an even-numbered perforated lateral line 32 and an odd-numbered perforated lateral line 31, according to the present invention.

A lateral space 42, of odd-numbered perforated lateral line 31, is facing lateral perforation 41 of even-numbered perforated lateral line 32. The size of lateral space 42 is determined according to the size of $d_2$ and the size of lateral perforation 41 is determined according to the size of $d_3$.

Figure 6:
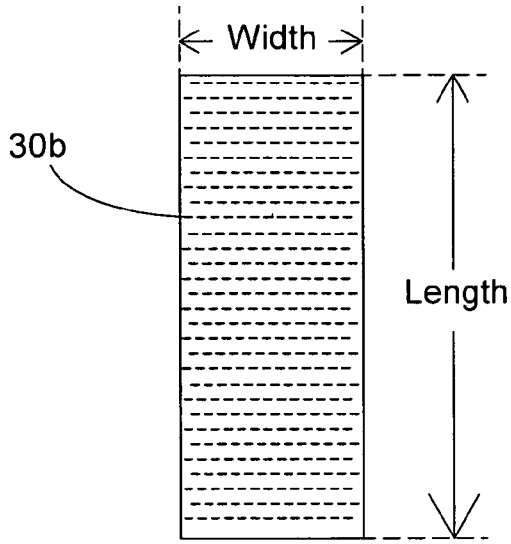
FIG. 6 is a top view schematic illustration of an exemplary, illustrative embodiment of hygienic paper with perforated lateral lines, showing definition of the width and length dimensions of the paper.

FIG. 6 is a top view schematic illustration of an exemplary, illustrative embodiment of hygienic paper with perforated lateral lines 30*b*, defining the width and length dimensions of the hygienic paper in general and specifically those of the hygienic paper with perforated lateral lines 30*b*, according to the present invention.

Figure 7:
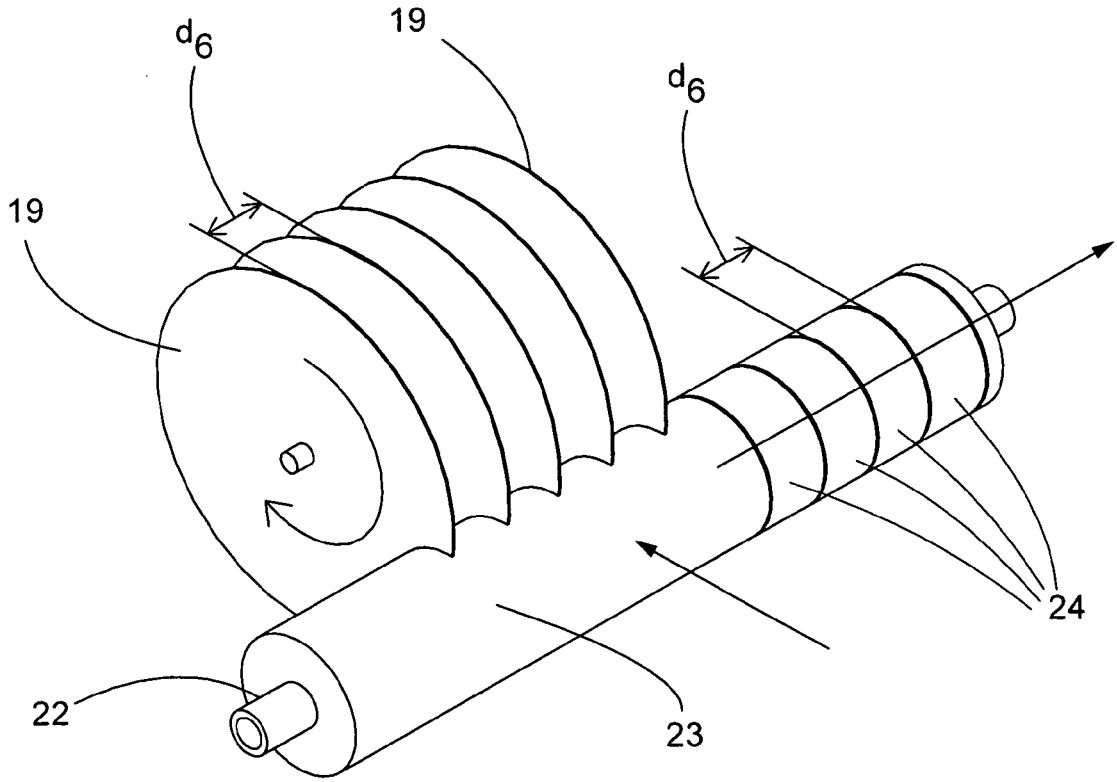
FIG. 7 is a perspective schematic illustration of an exemplary, illustrative embodiment of knives for longitudinal cutting, in the process of performing longitudinal cuts of an inner tube (of a rigid material) and of a roll of hygienic paper rolled onto an inner tube, (with perforated lateral lines), according to the present invention.

FIG. 7 is a perspective schematic illustration exemplary, illustrative embodiment of knives for longitudinal cutting 19 when performing longitudinal cuts (33) in inner tube 22 and in the roll of hygienic paper rolled onto an inner tube 23 according to the present invention.

It is possible to have an apparatus in which the amount of knives for longitudinal cutting 19 enables performing the cutting in a single action, or with a smaller amount of knives, necessitating more than one stroke to perform the cutting.

The knives for longitudinal cutting 19 can be shaped as rotating discs, as shown in the illustration, or in any other suitable shape. When the distance between every two knives for longitudinal cutting 19 is $d_6$, the end product is rolls of disposable pieces of hygienic paper 24, whose width is $d_6$.

Figure 8:
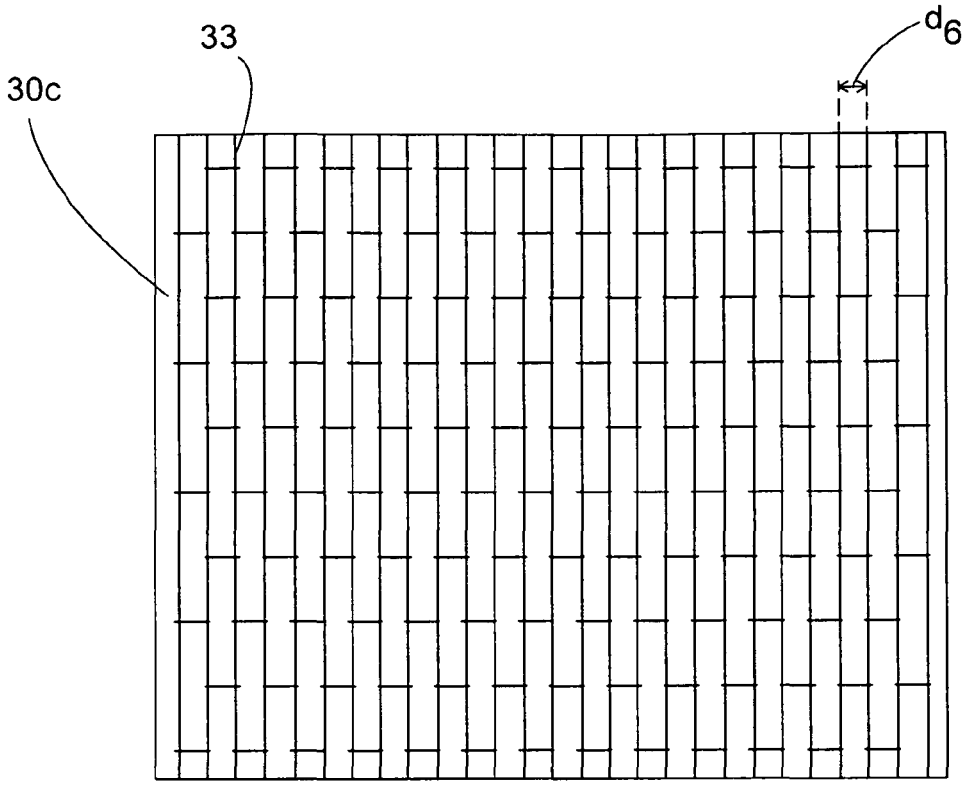
FIG. 8 is a top view schematic illustration of an exemplary, illustrative embodiment of longitudinal cuts of hygienic paper, with perforated lateral lines, according to the present invention.

FIG. 8 is a top view schematic illustration of an exemplary, illustrative embodiment of hygienic paper with longitudinal cuts 30*c*, (and with perforated lateral lines), according to the present invention, when the paper is spread out. This state is not required in the production process, but rather is shown here for the purpose of explanation.

Figure 9:
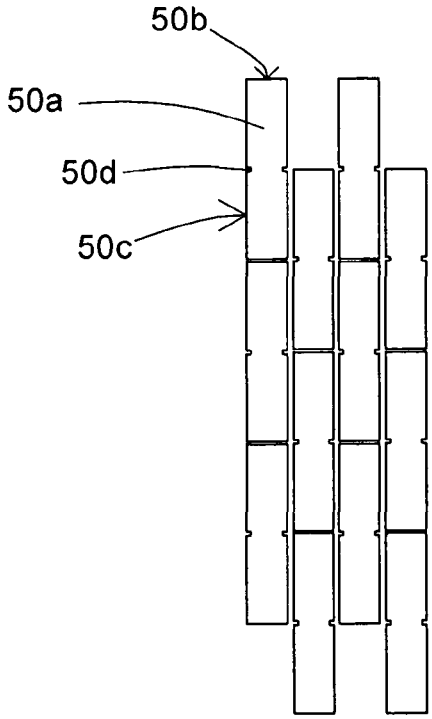
FIG. 9 is a top view schematic illustration of an exemplary, illustrative embodiment of a few disposable pieces of hygienic paper, according to the present invention.

FIG. 9 is a top view schematic illustration of an exemplary, illustrative embodiment of a few disposable piece of hygienic paper 50*a*, according to the present invention. A single disposable piece of hygienic paper 50*a* has a short edge 50*b* whose size equals $d_6$ and a long edge whose size equals $d_5$.

Furthermore, the disposable piece of hygienic paper 50*a* carries two remnants of lateral perforation 50*d*.

While the invention has been described with respect to a limited number of embodiments, it will be appreciated that many variations, modifications and other applications of the invention may be made.

What is claimed is:

1. An apparatus for producing rolls of disposable pieces of hygienic paper, the apparatus comprising:

(a) a spiral blade cylinder having a spiral blade cylinder rotation axis;

(b) a spiral blade having a spiral blade radius, wherein said spiral blade is disposed upon said spiral blade cylinder;

(c) a segmented blade cylinder having a segmented blade cylinder rotation axis;

(d) a first segmented blade having a segmented blade radius, at least two bladed segments, and at least two blade lateral space, said first segmented blade is disposed upon said segmented blade cylinder, wherein each one of said bladed segments has a width dimension larger than each one of said blade lateral spaces' width dimension; and (e) a second segmented blade having a segmented blade radius, at least two bladed segments, and at least two blade lateral spaces, said second segmented blade is disposed at said segmented blade cylinder, wherein each one of said bladed segments has a width dimension larger than each one of said blade lateral spaces' width dimension, wherein said segmented blade cylinder rotation axis, said first segmented blade, and said second segmented blade are laying upon a common plane, wherein a bladed segment of said first segmented blade is facing a lateral space of said second segmented blade, and wherein a distance between said spiral blade cylinder rotation axis and said segmented blade cylinder rotation axis is substantially the sum of the spiral blade radius and the segmented blade radius.

2. The apparatus for producing rolls of disposable pieces of hygienic paper of claim 1 further comprising:

(f) an internal cylinder for carrying rolls of hygienic paper, wherein a roll of hygienic paper can be loaded on said internal cylinder for carrying rolls of hygienic paper; and (g) an internal cylinder for carrying an inner tube, wherein an inner tube can be loaded on said internal cylinder for carrying an inner tube, and wherein said hygienic paper can move from said roll of hygienic paper and be rolled around said inner tube, to form a roll of hygienic paper, with perforated lateral lines rolled onto said inner tube.

3. The apparatus for producing rolls of disposable pieces of hygienic paper of claim 2 further comprising:

(h) a knife for lateral cutting enabling separation of said roll of hygienic paper, with perforated lateral lines, rolled onto an inner tube from said remaining hygienic paper.

4. The apparatus for producing rolls of disposable pieces of hygienic paper of claim 3 further comprising:

(i) at least one knife for longitudinal cutting, enabling separation of rolls of disposable pieces of hygienic paper from said roll of hygienic paper, with perforated lateral lines, rolled onto an inner tube.

5. A process for producing rolls of disposable pieces of hygienic paper comprising the stages of:

(a) providing hygienic paper with a surface and thickness, width, and length dimensions, for producing rolls of disposable pieces of hygienic paper with predetermined width, and length dimensions of said pieces of hygienic paper;

(b) cutting a first perforated lateral line on said hygienic paper, wherein said perforated lateral line includes at least two lateral perforations and at least one lateral space, wherein said lateral space is shorter than one of said lateral perforations;

(c) cutting a second perforated lateral line on said hygienic paper, wherein said perforated lateral line includes at least two lateral perforations and at least one lateral space, wherein each of said lateral space of said second perforated lateral line is shorter than one of said lateral perforations of said second perforated lateral line, wherein each of said lateral space of said first perforated lateral line is facing one of said lateral perforations of said second perforated lateral line;

(d) cutting additional perforated lateral lines, wherein there is a longitudinal distance between each of every two neighboring even-numbered perforated lateral lines and between each of every two neighboring odd-numbered perforated lateral lines, and wherein said longitudinal distance determines length dimensions of said disposable pieces of hygienic paper.

6. The process for producing rolls of disposable pieces of hygienic paper of claim 5 further comprising the stages of:

(e) providing an inner tube; and (f) rolling said hygienic paper around said inner tube.

7. The process for producing rolls of disposable pieces of hygienic paper of claim 6 further comprising the stages of:

(g) cutting longitudinal cuts along said hygienic paper and cutting said inner tube, wherein there is a lateral space between each of every two of said neighboring longitudinal cuts, and wherein said lateral space determines width dimensions of said disposable pieces of hygienic paper, wherein said width dimensions of said disposable pieces of hygienic paper are shorter than one of said lateral perforations.

8. An apparatus for producing rolls of disposable pieces of hygienic paper, the apparatus comprising:

(a) a spiral blade cylinder having a spiral blade cylinder rotation axis;

(b) a spiral blade having a spiral blade radius, wherein said spiral blade is disposed upon said spiral blade cylinder;

(c) a segmented blade cylinder having a segmented blade cylinder rotation axis;

(d) at least two segmented blades, wherein each one of said segmented blades has a segmented blade radius, at least two bladed segments, and at least two blade lateral spaces, said each one of said segmented blades is disposed upon said segmented blade cylinder, wherein each one of said bladed segments has a width dimension, wherein a bladed segment of each one of said segmented blades is facing a lateral space of another one of said segmented blade, and wherein a distance between said spiral blade cylinder rotation axis and said segmented blade cylinder rotation axis is substantially the sum of the spiral blade radius and the segmented blade radius.

9. The apparatus for producing rolls of disposable pieces of hygienic paper of claim 8, further comprising:

(e) an internal cylinder for carrying rolls of hygienic paper, wherein a roll of hygienic paper can be loaded on said internal cylinder for carrying rolls of hygienic paper; and (f) an internal cylinder for carrying an inner tube, wherein an inner tube is loaded on said internal cylinder for carrying an inner tube, and wherein said hygienic paper can be moved, from said roll of hygienic paper and be rolled around said inner tube, to form a roll of hygienic paper, with perforated lateral lines rolled onto said inner tube.

10. The apparatus for producing rolls of disposable pieces of hygienic paper of claim 9, further comprising:

(g) at least two knives for longitudinal cutting, enabling separation of rolls of disposable pieces of hygienic paper from said roll of hygienic paper, with perforated lateral lines, rolled onto an inner tube, wherein there is a distance between every two knives for longitudinal cutting, and wherein said distance between every two knives for longitudinal cutting is shorter than one of said bladed segments.

* * * * *